United States Patent [19]

Ingle et al.

[11] 4,262,964

[45] Apr. 21, 1981

[54] SYSTEM FOR DETECTING INTERFACES BETWEEN MINERAL SEAMS AND THE SURROUNDING EARTH FORMATIONS

[75] Inventors: James E. Ingle, Edmond; Jack L. Moon, Oklahoma City, both of Okla.

[73] Assignee: Kerr-McGee Corporation, Oklahoma City, Okla.

[21] Appl. No.: 47,206

[22] Filed: Jun. 11, 1979

Related U.S. Application Data

[63] Continuation-in-part of Ser. No. 768,650, Feb. 14, 1977, Pat. No. 4,160,566.

[51] Int. Cl.[3] ..... E21C 35/24

[52] U.S. Cl. ..... 299/1; 175/41; 299/30; 250/253; 250/498

[58] Field of Search ..... 299/1, 30, 18; 175/41; 450/253, 498

[56] References Cited

U.S. PATENT DOCUMENTS

| | | | |
|---|---|---|---|
| 3,177,364 | 4/1965 | Green | 250/498 |
| 3,432,667 | 3/1969 | Caldwell | 250/253 |
| 3,719,394 | 3/1973 | Hartley | 299/1 |
| 4,014,574 | 3/1977 | Todd | 299/18 |
| 4,082,362 | 4/1978 | Justice | 299/18 |
| 4,160,566 | 7/1979 | McGee | 299/18 |
| 4,165,460 | 8/1979 | Frosch | 250/253 |

*Primary Examiner*—William F. Pate, III
*Attorney, Agent, or Firm*—William G. Addison

[57] ABSTRACT

The present invention contemplates a system for detecting an interface between a mineral seam and the surrounding earth formation utilizing a radiation source and a radiation receiver mounted on a miner having a positionable cutter assembly. As the miner is moved into the coal seam, a first distance is continuously sensed between one surface formed in the mineral seam by the miner cutter assembly and the surrounding earth formation and the miner cutter assembly is positioned in response to the sensed first distance. As the miner is withdrawn from the coal seam, a second distance is continuously sensed between one surface formed in the mineral seam by the miner cutter assembly and the surrounding earth formation and the miner cutter assembly is positioned in response to the sensed second distance. A substantial portion of the space between the wall formed in the mineral seam by the miner cutter assembly and the radiation source and radiation receiver is substantially filled with a material having a density greater than the density of air to direct a substantial portion of the radiation through the mineral seam.

21 Claims, 10 Drawing Figures

SYSTEM FOR DETECTING INTERFACES BETWEEN MINERAL SEAMS AND THE SURROUNDING EARTH FORMATIONS

CROSS REFERENCE TO RELATED APPLICATIONS

The present application is a continuation-in-part of the co-pending application, U.S. Ser. No. 768,650, entitled "MINING APPARATUS", filed on Feb. 14, 1977 now U.S. Pat. No. 4,160,566 which is assigned to the assignee of the present invention.

BACKGROUND OF THE INVENTION

Field of the Invention

The present invention generally relates to a system for sensing an interface between a mineral seam and the surrounding earth formation and, more particularly, but not by way of limitation, to a system for sensing an interface between a mineral seam and the surrounding earth formation utilizing a radiation source and a radiation receiver.

BRIEF DESCRIPTION OF THE DRAWINGS

FIG. 3 is a plan view of the miner of FIG. 2.

DESCRIPTION OF THE PREFERRED EMBODIMENTS

The disclosure in the co-pending application, U.S. Ser. No. 786,650, entitled "Mining Apparatus", filed on Feb. 14, 1977, which is assigned to the assignee of the present invention, specifically is incorporated herein by reference.

Figure 1:
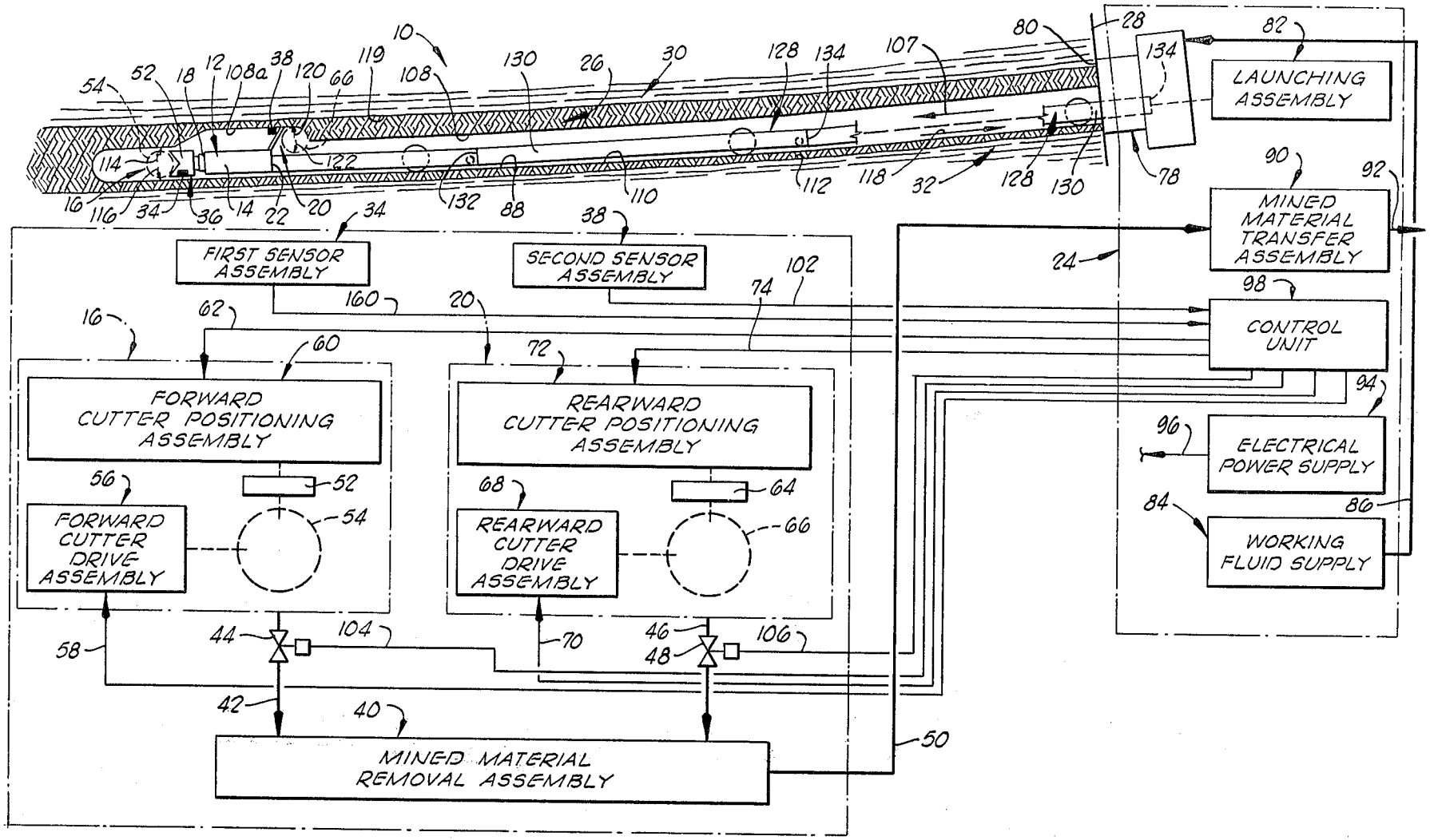
FIG. 1 is a diagrammatic, schematic view of a mining machine assembly incorporating and utilizing the sensor assembly of the present invention.

Referring to the drawings in general and to FIG. 1 in particular, shown therein and designated via the general reference numeral 10 is a mining assembly constructed and operated in accordance with the present invention. In general, the mining assembly 10 includes: a miner 12, having a frame 14, a forward cutter assembly 16 which is positionably connected to a forward end 18 of the frame 14, and a rearward cutter assembly 20 which is positionably connected to a rearward end 22 of the frame 14; and a surface assembly 24. The mining assembly 10 is constructed and operated to excavatingly remove coal from a coal seam (diagrammatically shown in FIG. 1 and designated therein via the general reference numeral 26) which extends into the earth from a surface highwall 28. The coal seam 26 extends into an earth formation and the portion of the earth formation immediately above the coal seam sometimes is referred to herein as an overburden (the overburden being diagrammatically shown in FIG. 1 and designated therein via the general reference numeral 30), the portion of the earth formation immediately below the coal seam sometimes being referred to herein as an underburden (the underburden being diagrammatically shown in FIG. 1 and designated therein via the general reference numeral 32).

It should be noted that, although the mining assembly and the various components and assemblies thereof and the various methods are described herein in conjunction with the mining of coal from a coal seam, the various apparatus and methods of the present invention are not limited to this particular embodiment and the present invention may be utilized to excavatingly remove other materials or minerals.

In addition, it should be noted that the terms "forward", "rearward", "upper", "lower" and other words describing the relative positions of various elements, assemblies and components of the present invention are utilized herein solely for the purpose of facilitating the description of the present invention and such terms are not to be construed to limit the present invention as defined in the claims. Further, the terms "overburden" and "underburden" are utilized herein solely for the purpose of facilitating the description of the present invention and such terms are not to be construed to limit the present invention as defined in the claims.

The miner 12 also includes: a first sensor assembly 34 which is connected to the miner and positioned generally near the forward cutter assembly 16 and generally near a lower surface 36 of the miner 12; a second sensor assembly 38 which is connected to the miner 12 generally near the rearward cutter assembly 20; and a mined material removal assembly 40, which is connected to the forward cutter assembly 16 via a conduit 42 having a valve 44 interposed therein, and which is connected to the rearward cutter assembly 20 via a conduit 46 having a valve 48 interposed therein, the mined material removing assembly 40 receiving the mined material via either the conduit 42 or the conduit 46 and discharging the mined material through a conduit 50. In one form, the mined material removal assembly 40 also could receive and inject compressed gas into the slurry in a manner and for reasons described in the co-pending application referred to before.

The forward cutter assembly 16 includes: a forward cutter frame 52, which is movably connected to the forward end 18 of the frame 14; a forward cutter 54, which is mechanically connected to and rotatably mounted on the forward cutter frame 52, the forward cutter 54 being constructed and mounted on the forward cutter frame 52 for excavatingly engaging the material to be mined; a forward cutter drive assembly 56, which is mechanically connected to the forward cutter 54, the forward cutter drive assembly 56 rotatingly driving the forward cutter 54 in response to receiving a signal via a control line 58; and a forward cutter positioning assembly 60, which is mechanically connected to the forward cutter frame 52 and which receives a signal via a control line 62, the forward cutter positioning assembly 60 moving the forward cutter frame 52 and the forward cutter 54 in response to the signal received via the control line 62.

The rearward cutter assembly 20 includes: a rearward cutter frame 64, which is movably connected to the rearward end 22 of the frame 14; a rearward cutter 66, which is mechanically connected to and rotatably mounted on the rearward cutter frame 64, the rearward cutter 66 being constructed and mounted on the rearward cutter frame 64 for excavatingly engaging the material to be mined; a rearward cutter drive assembly 68, which is mechanically connected to the rearward cutter 66, the rearward cutter drive assembly 68 rotatingly driving the rearward cutter 66 in response to receiving a signal via a control line 70; and a rearward cutter positioning assembly 72, which is mechanically connected to the rearward cutter frame 64 and which receives a signal via a control line 74, the rearward cutter positioning assembly 72 moving the rearward cutter frame 64 and the rearward cutter 66 in response to the signal received via the control line 74.

The surface assembly 24 is constructed to launch and force or drive the miner 12 into the coal seam 26 and to retrieve or withdraw the miner 12 from the coal seam 26 and, in general, to control the movement of the miner 12 through the coal seam. The surface assembly 24 also includes: a caisson 78 having one end 80 sealingly engagable with a portion of the highwall 28 and being constructed such that the miner 12 and associated equipment are movable through the caisson 78 and into and from the coal seam 26 during the operation of the mining assembly 10; a launching assembly 82 for moving the miner 12 and associated equipment through the caisson 78 and through the coal seam 26; a working fluid supply 84 for passing working fluid through a conduit 86 and into a borehole 88 formed through the coal seam 26 via the miner 12; a mined material transfer assembly 90 for receiving the mined material passed from the mined material removal assembly 40 through the conduit 50 and passing or transferring the mined material through a conduit 92 for further processing or utilization; an electrical power supply 94 for supplying the operating electrical power for the miner 12 via a cable 96; and a control unit 98, which receives a signal from the first sensor assembly 34 on a control line 100 and provides the signal on the control line 62 in response thereto for positioning the forward cutter 54, and which receives a signal provided by the second sensor assembly 38 on a control line 102 and provides the signal on the control line 74 in response thereto for positioning the rearward cutter 66, the control unit 98 also providing the signals on the control lines 58 and 70. The valves 44 and 48 each have opened and closed positions and the position of each of the valves 44 and 48 is remotely controllable in response to signals provided on control lines 104 and 106, respectively, the signals on the control lines 104 and 106 being provided by the control unit 98.

In general, the working fluid supply 84 is connected to the caisson 78 via the conduit 86 in a manner such that working fluid can be passed through the caisson 78 and into the borehole 88. The miner 12 is positioned in the launching assembly 82 and oriented such that the coal seam 26 initially is engaged by the forward cutter assembly 16 as the miner initially is launched into the coal seam 26, the launching assembly 82 engaging and forcing the miner through the coal seam in a general direction 107.

When the miner 12 initially is launched into the coal seam 26, the control unit 98 provides a signal on the control line 58 and the forward cutter drive assembly 56 rotatingly drives the forward cutter 54 in response to receiving the signal from the control unit 98 on the control line 58. In this operating mode, the control unit 98 provides a signal on the control line 104 and the valve 44 is positioned in the opened position in response to receiving the signal from the control unit 98 on the control line 104, thereby providing communication between the forward cutter assembly 16 and the mined material removal assembly 40 via the conduit 42. The control unit 98 provides a signal on the control line 106 and the valve 48 is positioned in the closed position in response to receiving the signal on the control line 106 in this operating mode of the miner 12, thereby interrupting fluidic communication between the rearward cutter assembly 20 and the mined material removal assembly 40. The control unit 98 provides a signal on the control line 70 and the rearward cutter drive assembly 68 is conditioned such that the rearward cutter 66 is not rotatingly driven as the miner 12 is moved into the coal seam 26 in the direction 107. The control unit 98 provides the signal on the control line 74 and the rearward cutter positioning assembly 72 is conditioned to move the rearward cutter frame 64 and the rearward cutter 66 connected thereto to a storage position wherein the rearward cutter 66 does not excavatingly engage the coal seam 26 as the miner 12 is moved into the coal seam 26 in the direction 107.

Working fluid is passed into the borehole 88 from the working fluid supply 84 via the conduit 86, and the borehole 88 substantially is filled with the working fluid, the working fluid supply 84 operating to maintain the borehole 88 filled with working fluid as the miner 12 is moved into and withdrawn from the coal seam 26, for reasons described in the co-pending application referred to before. In addition, the working fluid cooperates with the sensor assemblies 34 and 38 in a manner to be described below.

In this operating mode when the miner 12 is being moved into and through the coal seam 26, the forward cutter 54 excavatingly engages the material (coal) to be mined and dislodges or disengages the material (coal) from the coal seam 26. The excavated coal is suspended in the working fluid and the mined material (coal) and the working fluid form a slurry, the slurry of the mined material (coal) and the working fluid being removed by the forward cutter assembly 16 into the conduit 42 as the material is excavated from the coal seam 26. The slurry is passed through the conduit 42 into the mined material removal assembly 40 and the slurry is passed from the mined material removal assembly 40 through the conduit 50 to the mined material transfer assembly 90.

The borehole 88 forms a shaft extending through the coal seam having sidewalls and an upper wall or roof 108 and a lower wall or floor 110. As the miner 12 is being moved into the coal seam in the direction 107, the first sensor assembly 34 operates to sense the distance between the floor 110 and an interface 112 between the coal seam 26 and the underburden 32. The first sensor assembly 34 provides an output signal on the control line 100 indicative of the sensed first distance. The signal on the control line 102 indicative of the sensed first distance is received by the control unit 98 and the first distance is determined by the control unit 98. It is desirable to minimize the first distance during the operation of the mining assembly 10 as the miner 12 is being moved into the coal seam 26 in the direction 107 to maximize the amount of coal removed from the coal seam 26. The control unit 98 provides a signal on the control line 62 in response to the determined first distance to cause the forward cutter positioning assembly 60 to move the forward cutter 54 in a direction 114 generally toward the overburden 30 or in a direction 116 generally toward the underburden 32 to minimize the first sensed distance determined in response to the signal received from the first sensor assembly 34. The control unit 98 also functions to provide signals on the control line 62 for positioning the forward cutter to guidingly steer the miner 12 through the coal seam in a manner described in detail in the co-pending application referred to before.

When it is desired to withdraw the miner 12 from the borehole 88 in a direction 118, the control unit 98 provides a signal to the forward cutter drive assembly 56 on the control line 58 and the forward cutter drive assembly 56 ceases driving the forward cutter 54 in response to the received signal in the control line 58 in this operating withdrawal mode of the mining assembly 10. Then, the control unit 98 provides a signal to the rearward cutter positioning assembly 72 on the control line 74 and the rearward cutter positioning assembly 72 moves the rearward cutter frame 64 and the rearward cutter 66 connected thereto from the storage position to a material engaging position (diagrammatically shown in dashed-lines in FIG. 1) in response to receiving this signal on the control line 74. In the material engaging position of the rearward cutter assembly 20, the rearward cutter 66 is positioned to excavatingly engage a portion of the coal seam 26 which was not engaged via the forward cutter 54 during the movement of the miner 12 into the coal seam 26 in the direction 107. Thus, the rearward cutter 64 excavates additional material (coal) from the coal seam 26, thereby enlarging the borehole 88 as the miner 12 is withdrawn from the borehole 88 in the withdrawal direction 118. More particularly, as the miner 12 is being withdrawn from the borehole 88 in the direction 118, the rearward cutter 66 is positioned to excavatingly engage a portion of the coal seam 26 generally adjacent the roof 108 formed via the forward cutter 54, the rearward cutter 66 operating to enlarge the borehole 88 as the miner 12 is being withdrawn from the coal seam 26. The operation of the rearward cutter 66 forms a new upper wall or roof as the rearward cutter 66 excavatingly engages the coal seam while the miner 12 is being withdrawn in the direction 118 (the roof formed by the operation of the rearward cutter 66 being designated by the reference numeral 108a).

The second sensor assembly 38 is positioned on the rearward cutter assembly 20 so that the second sensor assembly 38 is positioned near the roof 108a formed by the rearward cutter 66. The second sensor assembly 38 operates to sense the distance between the roof 108a formed by the rearward cutter 66 and an interface 119 between the overburden 30 and the coal seam 26, the second sensor assembly 38 providing an output signal on the control line 102 indicative of the second distance sensed by the second sensor assembly 38. The control unit 98 receives the signal provided by the second sensor assembly 38 and provides an output signal on the control line 74 to move the rearward cutter 66 in a direction 120 generally toward the overburden 30 or a direction 122 generally toward the underburden 32 (generally away from the overburden 30) in response to the signal received from the second sensor assembly 38 to minimize the second distance or, in other words, to maximize the amount of coal removed from the coal seam 26.

The rearward cutter 66 also is utilized to assist in withdrawing the miner 12 from the borehole 88 by effectively cutting the miner 12 out from the borehole 88 in the event the walls or roof or portions thereof formed in the coal seam 26 via the borehole 88 fall or collapse between the miner 12 and the surface.

Prior to providing the signal for positioning the rearward cutter 66 in the material engaging position, the control unit 98 provides a signal to the rearward cutter drive assembly 68 on the control line 70 and the rearward cutter drive assembly 68 rotatingly drives the rearward cutter 66, the rearward cutter 66 excavatingly engaging the coal seam 26 as the rearward cutter 66 is moved into the material engaging position.

Further, before the rearward cutter assembly 20 is positioned in the material engaging position, the control unit 98 provides a signal on the control line 104 and the valve 44 is positioned in the closed position in response to receiving this signal, thereby interrupting communication between the forward cutter assembly 16 and the mined material removal assembly 40. The control unit 98 provides a signal on the control line 106 and the valve 48 is positioned in the opened position in response to receiving this signal, thereby establishing communication between the rearward cutter assembly 20 and the mined material removal assembly 40 via the conduit 46.

After the rearward cutter assembly 20 has been positioned in the material engaging position, the miner 12 is withdrawn from and through the coal seam 26 via the launching assembly 82 in the withdrawal direction 118. As the miner 12 is moved in the withdrawal direction 118, the rearward cutter 66 excavatingly engages the material (coal) to be mined and dislodges or disengages the material (coal) from the coal seam 26. The excavated material (coal) is suspended in the working fluid and the mined material (coal) and the working fluid form a slurry, the slurry of the mined material (coal) and the working fluid being moved via the rearward cutter assembly 20 into the conduit 46 as the material is excavated from the coal seam 26 via the rearward cutter 64. The slurry including the material (coal) excavated via the rearward cutter 66 is passed through the conduit 46 into the mined material removal assembly 40.

The forward cutter assembly 16 does not function to excavatingly engage the material (coal) while moving the miner 12 in the direction 118; however, the forward cutter assembly 16 does function to steer and guide the miner 12 along a path determined via the control unit 98 output signals on the control line 62 which are connected to and received by the forward cutter positioning assembly 60, the forwardly cutter positioning assembly 60 positioning the forward cutter frame 52 and the forward cutter 54 connected thereto in response to the output signals received on the control line 62 from the control unit 98.

The slurry comprising the material (coal) excavated via the rearward cutter 66 and the working fluid is passed from the mined material removal assembly 40 through the conduit 50 to the mined material transfer assembly 90 of the surface unit 76. The working fluid and the material (coal) excavated via the rearward cutter 66 are recovered from the slurry in a manner and for reasons like those described before with respect to the material (coal) excavated via the forward cutter assembly 16.

The mining apparatus 10 also includes a plurality of carriers 128, and each carrier 128 includes a carrier frame 130 having a forward end 132 and a rearward end 134. The forward end 132 of each carrier frame 130 is connectable either to the miner 12 or to the rearward end 134 of one of the carrier frames 130.

After the miner 12 has been moved a distance into and through the coal seam 26, the forward end 132 of the carrier frame 130 of one of the carriers 128 is connected to the miner 12. Then, the launching assembly 82 engages a portion of the carrier 128 which is connected to the miner 12 and the launching assembly 82 forces the engaged carrier 128 into the coal seam 26 or, more particularly, into the borehole 88, thereby forcing the miner 12 connected thereto into and through the coal seam 26 in the direction 124.

After the miner 12 and carrier 128 connected thereto has been forcibly moved a distance into and through the coal seam 26 via the launching assembly 82, the forward end 132 of another carrier frame 130 is connected to the rearward end 134 of the carrier frame 130 which is connected to the miner 12. Then, the launching assembly 82 engages a portion of the carrier 128 which has been connected to the carrier 128 connected to the miner 12 and the launching assembly 82 forces the engaged carrier 128 into the borehole 88, thereby forcing the miner 12 into and through the coal seam 26 in the direction 107.

The forward end 132 of additional carrier frames 130 sequentially are connected to the rearward end 132 of the prior connected carrier frame 130. The launching assembly 82 engages a portion of the last connected carrier frames 130 and forces the engaged carrier frame 130 and the carrier frames 130 and the miner 12, which are connected to the engaged carrier frame 130, into and through the coal seam 26 in the direction 107.

The carriers 128 are connected to the miner 12 and the miner 12 is forcibly moved into and through the coal seam 26 in the direction 107 via the force applied to last connected carrier 128 and transmitted to the miner 12 through the carriers 128 connected thereto. The connecting of additional carriers 128 in series to the miner 12 is repeated and continued until the miner 12 has been moved some predetermined distance through the coal seam 26.

After the miner 12 has been moved the predetermined distance into and through the coal seam 26 in the direction 107, the miner 12 is withdrawn from the borehole 88 and the rearward cutter 66 excavatingly engages the coal seam 26 for excavating additional material (coal) as the miner 12 is withdrawn in the withdrawal direction 118. During the withdrawal of the miner 12, the launching assembly 82 engages one of the carriers 128 and forces the engaged carrier 128 in the withdrawal direction 118, this force being transmitted to the miner 12 via the carriers 128 connected to the miner 12 for forcibly moving the miner 12 through the coal seam 26 in the withdrawal direction 118.

After the miner 12 and the carriers 128 connected thereto have been moved a predetermined distance in the withdrawal direction 118, the last connected carrier 128 is disconnected and the launching assembly 82 is positioned in engagement with the carrier 128, which was connected to the carrier 128 just disconnected. The carriers 128 are driven via the launching assembly 82 in the withdrawal direction 118 through the caisson 78 and, as each carried 128 is driven through the launching assembly 82 in the withdrawal direction 118, the carrier 128 is disconnected and removed. The driving of the carriers 128 via the launching assembly 82 in the withdrawal direction 118 and the sequential disconnecting of the carriers 128 as the carriers 128 are passed or driven through the launching assembly 82 in the withdrawal direction 118 is continued until the miner 12 has been withdrawn from the borehole 88.

Figures 1, 2:
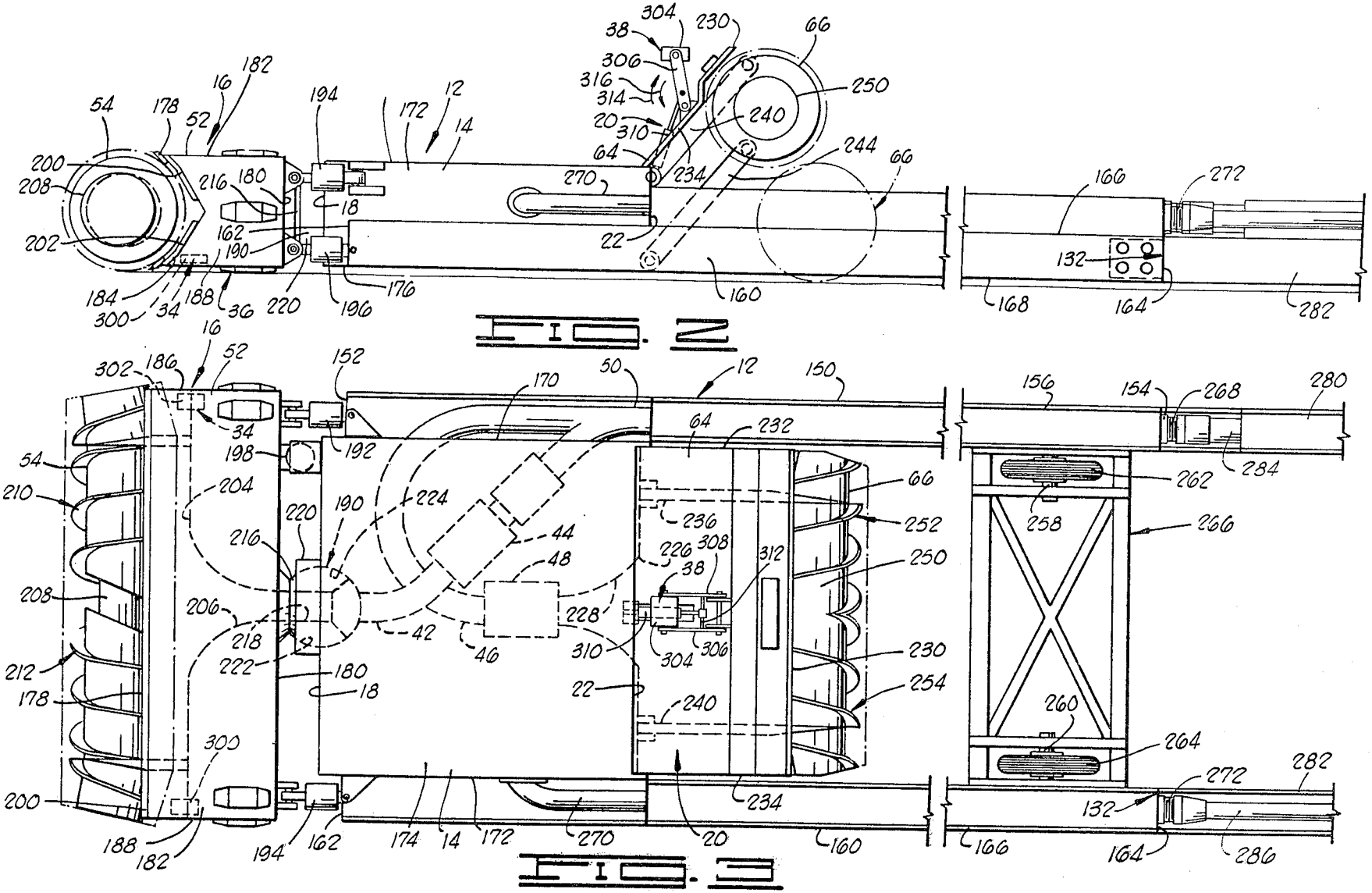
FIG. 2 is a side elevational view of the miner shown in FIG. 1, showing the rearward cutter assembly in a material engaging position in solid-lines and showing a portion of the rearward cutter assembly in a storage position in dashed-lines.

As shown in FIGS. 2 and 3, the miner 12 includes: a first beam 150, having a forward end 152, a rearward end 154, an upper surface 156 and a lower surface (not shown); and a second beam 160, having a forward end 162, a rearward end 164, an upper surface 166 and a lower surface 168, the second beam 160 being spaced a distance from the first beam 150 and extending generally parallel with respect to the disposition of the first beam 150. The frame 14 has a first side 170, a second side 172, an upper side 174 and a lower side 176. The distance between the beams 150 and 160 is sized such that the first beam 150 is disposed near one of the walls formed in the coal seam 26 via the borehole 88 and such that the second beam 160 is disposed near another wall formed in the coal seam 26 via the borehole 88 during the operation as the miner 12 is moved into and withdrawn from the coal seam 26. The spacing of the first and second beams 150 and 160 in this manner substantially protects the beams 150 and 160 from "roof falls".

The frame 14 is disposed and supported generally between the first and the second beams 150 and 160 with the first side 170 of the frame 14 being disposed generally adjacent and connected to a portion of the first beam 150, generally near the forward end 152 of the first beam 150, and the second side 172 of the frame 14 being disposed generally adjacent and connected to a portion of the second beam 160, generally near the forward end 162 of the second beam 160. The lower side 176 of the frame 14 is disposed in a plane generally coplanar with respect to the planar disposition of the lower surfaces 158 and 168 of the first and the second beams 150 and 160, respectively.

The forward end 18 of the frame 14 extends a distance beyond the forward ends 152 and 162 of the first and the second beams 150 and 160, respectively, and the rearward end 22 of the frame 14 is disposed generally between the forward ends 152 and 162 and the rearward ends 154 and 164 of the first and second beams 150 and 152, respectively. The upper side 174 of the frame 14 is spaced a distance above the upper surfaces 156 and 166 of the first and the second beams 150 and 160, respectively.

The forward cutter frame 52 has a forward end 178, a rearward end 180, an upper side 182, a lower side 184, a first side 186 and a second side 188. The rearward end 180 of the forward cutter frame 52 is positioned generally near and spaced a distance from the forward end 18 of the frame 14. The rearward end 180 of the forward cutter frame 52 is movably connected to the forward end 18 of the frame 14 via a universal connection 190, a portion of the universal connection 190 being connected to the rearward end 180 of the forward cutter frame 52 and a portion of the universal connection 190 being connected to the forward end 18 of the frame 14. The forward cutter frame 50 is movably positionable about axes defined by centerlines extending through the center of the pivotal connection between the frame 14 and the forward cutter frame 52 provided by the universal connection 190.

The forward cutter positioning assembly 58 includes a first steering cylinder 192, a second steering cylinder (not shown) which is disposed below the first steering cylinder 246, a third steering cylinder 194, a fourth steering cylinder 196 and a roll cylinder 198. Each of the cylinders 192, 194, 196 and 198 and the second steering cylinder (not shown) are connected to the frame 14 and to the forward cutter frame 52 and operated in a manner for movably positioning the forward cutter frame 52 with respect to the frame 14 generally about pivotal axes defined via the universal connection 190. The steering cylinders 192, 194, 196 and the second steering cylinder (not shown) and the roll cylinder 198 are each operated to position the forward cutter frame 52 in predetermined positions with respect to the frame 14 and with respect to pivotal axes defined via the universal connection 190 as the miner 12 is launched into the through the coal seam 26 in the direction 108 and as the miner 12 is withdrawn through the coal seam in the withdrawal direction 118 in a manner described in detail in the co-pending application referred to before.

The forward end 178 of the forwaard cutter frame 52 includes an inclined upper moldboard 200 and an inclined lower moldboard 202, the upper and the lower moldboards 200 and 202 each extending in a direction generally toward a central portion of the forward end 178 and in a direction generally from the forward end 178 toward the rearward end 180 of the forward cutter frame 52. The upper moldboard 200 extends a distance above the upper side 182, the forward cutter frame 52 and the lower moldboard 202 extends a distance below the lower side 184 of the forward cutter frame 52.

An opening 204 is formed through a central portion of the forward end 178 of the forward cutter frame 52 and a passageway 206 is disposed within the forward cutter frame 52, one end of the passageway 206 being connected to the forward end 178 and encompassing the opening 204 formed in the forward end 178 and the opposite end of the passageway 206 being connected to the rearward end 180 of the forward cutter frame 52. The passageway 206 extends through a central portion of the forward cutter frame 52 generally between the first and the second sides 186 and 188 and generally between the upper and the lower sides 182 and 184.

The forward cutter 52 is disposed generally near the forward end 178 of the forward cutter frame 52 and the forward cutter 54 is journally mounted on the forward end 178 of the forward cutter frame 52.

The forward cutter 54 includes a cutter shaft 208 having a first flight of vanes 210 extending a distance generally radially from the cutter shaft 208 and extending helically about the cutter shaft 208 in a generally clockwise direction, and a second flight of vanes 212 extending a distance generally radially from the cutter shaft 208 and extending helically about the cutter shaft 208 in a generally counterclockwise direction. The first flight of vanes 210 is oriented about the cutter shaft 208 to engage and move the excavated material (coal) generally toward the central portion of the forward end 178 in a direction generally from the first side 186 toward the second side 188, and the second flight of vanes 212 is oriented about the cutter shaft 208 to engage and move the excavated material (coal) generally toward a central portion of the forward end 178 in a direction generally from the second side 188 toward the first side 186. Thus, the first and the second flights of vanes 210 and 212 are oriented to engage and move the excavated material (coal) into the opening 204 formed in the forward end 178 of the forward cutter frame 52, the excavated material (coal) being moved into the opening 204 and through the passageway 206 as the miner 12 is being moved into and through the coal seam 26 in the direction 108.

The universal connection 190 includes a spherically shaped member 216, which is secured to the rearward end 178 of the forward cutter frame 52 at a position generally midway between the first and the second sides 186 and 188 of the forward cutter frame 52. A passageway 218 is formed through a central portion of the member 216, one end of the passageway 218 intersecting one portion of the spherically shaped member 216 and forming an opening in the outer surface of the member 216 and the opposite end of the passageway 218 intersecting a portion of the member 216 and forming an opening extending through the outer surface of the member 216. The member 216 is oriented on the forward end 178 such that one of the openings is generally aligned with the passageway 206 extending through the forward cutter frame 52. One portion of the passageway 218, generally near one of the openings, is enlarged with respect to the remaining portion of the passageway 218.

A housing 220 is connected to the forward end 18 of the frame 14 and an opening 222 is formed through the housing 220, the opening 222 being shaped to journally or bearingly engage a portion of the outer surface of the member 216. An opening 224 formed in a central portion of the forward end 18 of the frame 14 and the opening 224 is shaped to journally or bearingly engage a portion of the outer surface of the member 216. A portion of the member 216, generally opposite the portion of the member 216 which is connected to the forward cutter frame 52, is disposed in the opening 224 and the housing 220 extends about a portion of the member 216 or, more particularly the member 216 extends through the opening 222 formed in the housing 220. The opening 222 is aligned with the opening 224 in the frame 14 and the openings 222 and 224 cooperate to provide a bearing surface for engaging the member 216 as the member 216 is moved about axes defined via the universal connection 190. The housing 220 engages the member 216 and secures the member 216 in a connected position to the frame 14 while allowing the member 216 to be pivotally moved about the axes defined via the universal connection 190 during the operation of the miner 12.

The conduit 42 is disposed within a portion of the frame 14 and one end of the conduit 42 is supported generally adjacent the opening formed through the member 216, the conduit 42 being in fluidic communication with the passageway 218 formed through the member 216. The enlarged portion of the passageway 218 is sized such that the opening is larged than the opening through the conduit 42 and thus the enlarged portion operates to maintain fluidic communication between the passageway 218 and the conduit 42 as the member 216 is pivotally moved about axes defined via the universal connection 190.

The conduit 42 extends through the frame 14 and the end of the conduit 42, generally opposite the end of the conduit 42 which is disposed near the universal connection 190, is connected to the conduit 50, a portion of the conduit 42 extending through the first side 170 of the frame 14. An opening 226 is formed through a central portion of the rearward end 22 of the frame 14, generally midway between the first and the second sides 170 and 172 of the frame 14. The conduit 46 and the valve 48 interposed in the conduit 46 are each disposed within a portion of the frame 14. A portion 228 of the conduit 46 is enlarged with respect to the remaining portion of the conduit 46 and the enlarged end portion of the conduit 46 is connected to the rearward end 22 of the frame 14, the conduit 46 being oriented such that the opening formed through the enlarged end portion of the conduit 46 is in fluidic communication with the opening 226 formed through the rearward end 22 of the frame 14. The end of the conduit 46, opposite the end connected to the rearward end 22 of the frame 14, extends through a portion of the frame 14 and passes through the second side 172 of the frame 14, the end of the conduit 46, opposite the end of the conduit 46 connected to the rearward end 22 of the frame 14, is connected to the conduit 50. Thus, the opening 226 and the conduit 46 provide a passageway which extends through a portion of the frame 14 and is connected to the conduit 50, the passageway provided via the opening 226 and the conduit 46 providing communication between the rearward end 22 of the frame 14 and the conduit 44.

One end of the rearward cutter frame 64 is pivotally connected to the rearward end 22 of the frame 14, and the rearward cutter frame 64 extends a distance generally from the rearward end 22 of the frame 14 terminating with an outermost end 230. The rearward cutter frame 64 has a first side 232 and a second side 234 and the rearward cutter frame 64 is disposed generally between the first and the second beams 150 and 160, the first side 232 of the rearward cutter frame 64 being disposed generally near the first beam 150 and the second side 234 of the rearward cutter frame 64 being disposed generally near the second beam 160 in the storage position of the rearward cutter assembly 20.

The rearward cutter 66 is pivotally connected to the rearward end 22 of the frame 14 and disposed generally between the first and the second beams 150 and 160. More particularly, the rearward cutter assembly 20 includes a first pair of pivot arms 236 (only one of the first pair of pivot arms 236 being shown in FIGS. 2 and 3). One end of the pivot arm 236 is pivotally connected to the rearward end 22 of the frame 14 and the opposite end of the pivot arm 236 is pivotally connected to the rearward cutter 66. One end of the other pivot arm (not shown) of the first pair of pivot arms 236 is pivotally connected to the rearward end 22 of the frame 14 and the opposite end of this pivot arm (not shown) is pivotally connected to the rearward cutter 66.

The rearward cutter assembly 20 also inlcudes a second pair of pivot arms 240 and 244. One end of the pivot arm 240 is pivotally connected to the rearward end 22 of the frame 14 and the opposite end of the pivot arm 240 is connected to the rearward cutter 66. One end of the pivot arm 244 is pivotally connected to the rearward end 22 of the frame 14 and the opposite end of the pivot arm 244 is pivotally connected to the rearward cutter 66.

The pivot arms 236, 240 and 244 cooperate to pivotally secure the rearward cutter 66 to the rearward end 22 of the frame 14. The pivot arms 236, 240 and 244 are disposed generally between the first and the second beams 150 and 160 and, in the storage position of the rearward cutter assembly 20, the pivot arms 236, 240 and 244 each extend a distance from the rearward end 22 of the frame 14 and each is disposed generally between the first and the second beams 150 and 160. In one embodiment, the rearward cutter frame 64 is secured to the pivot arms 236 and 240 and, in this embodiment, the pivot arms 236 and 240 structurally support the rearward cutter frame 64 and pivotally connect the rearward cutter frame 64 to the frame 14. A pair or rear cylinders 246 and 248 are connected to the rearward end 22 of the frame 14 and to the rearward cutter frame 64 for pivotally moving the rearward cutter assembly 20 to a storage position and to a material engaging position.

The rearward cutter 66 includes a cutter shaft 250 having a first flight of vanes 252 extending a distance generally radially from the cutter shaft 250 and extending helically about the cutter shaft 250 in a generally counter-clockwise direction, and a second flight of vanes 256 extending a distance generally radially from the cutter shaft 250 and extending helically about the cutter shaft 250 in generally a clockwise direction. The first flight of vanes 252 is oriented about the cutter shaft 250 to engage and move the excavated material (coal) generally toward a central portion of the rearward end 22 of the frame 14 in a direction generally from the first side 186 toward the second side 188, and the second flight of vanes 256 is oriented about the cutter shaft 250 to engage and move the excavated material (coal) generally toward the central portion of the rearward end 22 in a direction generally from the second side 188 toward the first side 186. Thus, the first and the second flights of vanes 252 and 256 are oriented to engage and move the excavated material (coal) into the opening 226 formed in the rearward end 22 of the frame 14, the excavated material (coal) being moved into the opening 226 and through the passageway defined via the conduit 46 as the miner 12 is being moved through the coal seam 26 in the withdrawal direction 118.

One end of an axle 258 is connected to the first beam 150, generally near the rearward end 154 thereof, and one end of an axle 260 is connected to the second beam 160, generally near the rearward end 164 thereof, the axles 258 and 260 being disposed generally near the rearward ends 154 and 164. A first wheel 262 is bearingly mounted on the axle 258 and disposed generally near the first beam 150. A second wheel 264 is bearingly mounted on the axle 260 and disposed generally near the second beam 160. The wheels 262 and 264 cooperate to reduce friction and to rollingly support the rearward end of the miner 12.

A framework 266 is disposed between the first and the second beams 150 and 160, generally near the rearward ends 154 and 164. One end of the framework 266 is connected to the first beam 150 and the opposite end of the framework 266 is connected to the second beam 160. The framework 226 structurally supports the rearward end portions of the first and the second beams 150 and 160 in the spaced-apart relationship.

The conduit 50 extends along the first beam 150 and terminates with a threaded end 268, which is disposed generally near the rearward end 154 of the first beam 150. One end of a conduit 270 is connected to the frame 14 and the conduit 270 extends along the second beam 160 terminating with a threaded end 272, which is disposed generally near the rearward end 164 of the second beam 160. The various control lines 58, 62, 70, 74, 96, 100, 102, 104 and 106 extend through conduit 270 from the remote surface unit 76 to various components and assemblies of the miner 12.

The carriers 128 are each constructed in a similar manner and each carrier 128 includes a first carrier beam 280 and a second carrier beam 282 (only partially shown in FIGS. 2 and 3). The construction of the carriers 128 is described in detail in the co-pending application referred to before.

A conduit 284 is disposed on the first carrier beam 280 and the conduit 284 extends along the first carrier beam 280 with one end of the conduit 284 being disposed near the forward end 132 and the opposite end of the conduit 364 being disposed near the rearward end 134. The end of the conduit 284 disposed near the forward end 132 is adapted to be connected to the end 268 of the conduit 50 on the miner 12 or to the end of another conduit 268 disposed near the rearward end 134 of one of the other carriers 128. The end of the conduit 284 disposed near the rearward end 134 of the carrier 128 (not shown in FIGS. 2 and 3) is adapted to be connected to the end of another conduit 268 disposed near the forward end 132 of one of the other carriers 128.

A conduit 286 is disposed on the second carrier beam 282 and the conduit 286 extends along the second carrier beam 282 with one end of the conduit 286 being disposed near the forward end 132 and the opposite end of the conduit 286 being disposed near the rearward end 134. The end of the conduit 286 disposed near the forward end 132 of the carrier 128 is adapted to be connected to the end 272 of the conduit 270 on the miner 12 or to the end of another conduit 286 disposed near the rearward end 134 of one of the other carriers 128. The end of the conduit 286 disposed near the rearward end 134 of the carrier 128 is adapted to be connected to the end of another conduit 286 disposed near the forward end 132 of one of the other carriers 128.

In an assembled position with one or more carriers 128 connected to the miner 12, the conduit 50 on the miner 12 is connected to and in fluidic communication with the surface unit 74 via the interconnected conduits 284 on the carriers 128 and the conduit 270 is connected to the surface unit 74 via the interconnected conduits 286 on the carriers 128. In one operational embodiment, the conduit 284 on the last connected carrier 128 is connected to the mined material transfer assembly 90 via additional conduits (not specifically shown in the drawings, but diagrammatically illustrated in FIG. 1). Further, in an operational embodiment, the conduit 286 on the last connected carrier 128 is connected to the control unit 98 and to the electrical power supply 94 via additional conduits (not shown).

In one form as shown in FIGS. 2 and 3, the first sensor assembly 34 includes a first sensor 300 and a second sensor 302. The first sensor 300 is connected to the forward cutter frame 52 and disposed near the second side 188 and near the lower side 184. Further, the first sensor 300 is disposed near the forward end 178 of the forward cutter frame 52 and, more particularly, near the forward cutter 54. The second sensor 302 is connected to the forward cutter frame 52 and disposed near the first side 186 and near the lower side 184. Further, the second sensor 302 is disposed near the forward end 178 of the forward cutter frame 52 and, more particularly, near the forward cutter 54. In general, the first and the second sensors 300 and 302 are positioned on the forward cutter frame 52 so that the first and the second sensors 300 and 302 are each positioned as close as possible to the floor 110 and forward cutter 54 to enable the first and the second sensors 300 and 302 to sense the first distance between the floor 110 and the interface 112 at a position as close as possible to the forward cutter 54.

The second sensor assembly 38 includes a third sensor 304 which is connected to the rearward cutter frame 64 near the outermost end 230 and midway between the first and the second sides 232 and 234. The third sensor 304 is positioned on the rearward cutter frame 64 so that the third sensor 304 is positioned as close as possible to the roof 108*a* and the rearward cutter 66 to enable the third sensor 304 to sense the second distance between the roof 108*a* and the interface 119 at a position as close as possible to the rearward cutter 66.

The second sensor 304 is positionably mounted on the rearward cutter frame 64. The second sensor 304 is pivotally connected to one of the ends of a pair of pivot braces 306 and 308, and the opposite ends of each of the pivot braces 306 and 308 are pivotally connected to the rearward cutter frame 64. The base of a hydraulic cylinder 310 is pivotally connected to the rearward end 22 of the frame 14 and the rod of the cylinder 310 is pivotally connected to a bar 312, the bar 312 being connected to the pivot braces 306 and 308 thereby connecting the cylinder 310 to pivot braces 306 and 308.

The hydraulic cylinder 310 is connected to and remotely controlled by the control unit 98. In one actuated condition of the hydraulic cylinder 310, the third sensor 304 is positioned near the rearward cutter frame 64. In one other actuated condition of the hydraulic cylinder 310, the rod of the hydraulic cylinder 310 is moved outwardly from the base of the hydraulic cylinder 310 thereby pivotally moving the third sensor 304 in a direction 314 toward the roof 108*a* via the connection between the cylinder 310 and the third sensor 304 provided by the pivot braces 306 and 308. The hydraulic cylinder 310 continues to cause the third sensor 304 to be moved in the direction 314 until the third sensor 304 is positioned in an operative position wherein the third sensor 304 is positioned near the roof 108*a* and spaced a predetermined distance from the roof 108*a*. It is desirable to position the sensor 304 as near as possible to the roof 108*a* and as near as possible to the rearward cutter 66. Since the third sensor 304 is pivotally connected to the pivot braces 306 and 308, the third sensor 304 pivotally moves into a proper orientation with respect to the roof 108*a* as the third sensor 304 is moved in the direction 314.

When the rearward cutter assembly 20 is pivotally moved from the position shown in solid-line FIGS. 2 and 3 to the storage position shown in dashed-lines in FIG. 2, the control unit 98 conditions the hydraulic cylinder 310 to pivotally move the pivot braces 306 and 308 and the third sensor 304 connected thereto in the direction 316 to a position wherein the third sensor 304 is positioned in a storage position generally adjacent the rearward cutter frame 64.

Figure 4:
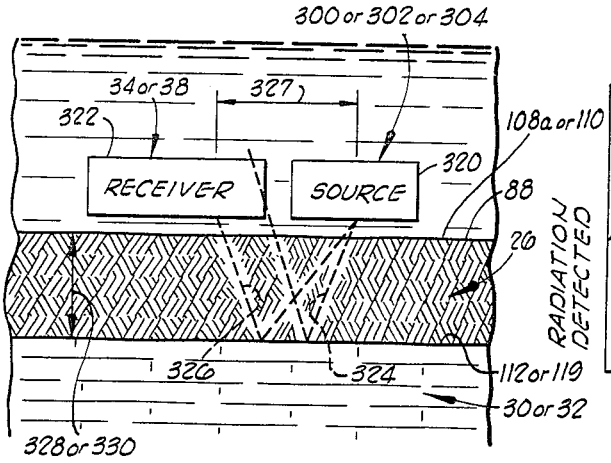
FIG. 4 is a diagrammatic, schematic view showing the sensor assembly of the present invention positioned near a wall formed in the mineral seam.

As shown in FIG. 4, each of the sensors, 300, 302 and 304 are constructed in a similar manner and each of the sensors 300, 302 and 304 includes: a radiation source 320 and a radiation receiver 322. The radiation source 320 emits radiation which is directed such that the emitted radiation moves through the coal seam 26 and is reflected from the interface 112 or 119. The radiation receiver 320 is positioned near the radiation source 320 and the radiation receiver 322 is constructed to receive the radiation emitted from the radiation source 320 and reflected from the interface 112 or 119.

During the operation of the first and second sensor assembly 34 and 38, radiation is emitted from the radiation source 320 and the emitted radiation travels or passes through the coal seam 26, as diagrammatically shown in FIG. 4 wherein the radiation is illustrated via the dashed-lines 324 and 326. The emitted radiation is reflected from the interface 112 or 119 and passes back through the coal seam 26. The radiation receiver 322 receives or detects the radiation reflected from the interface 112 or 119.

Figure 7:
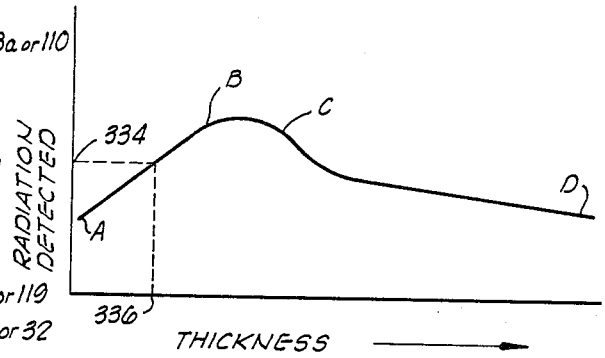
FIG. 7 is a graph illustrating some aspects of the operation of the sensor assembly of the present invention in determining the thickness of the coal seam.
Figure 5:
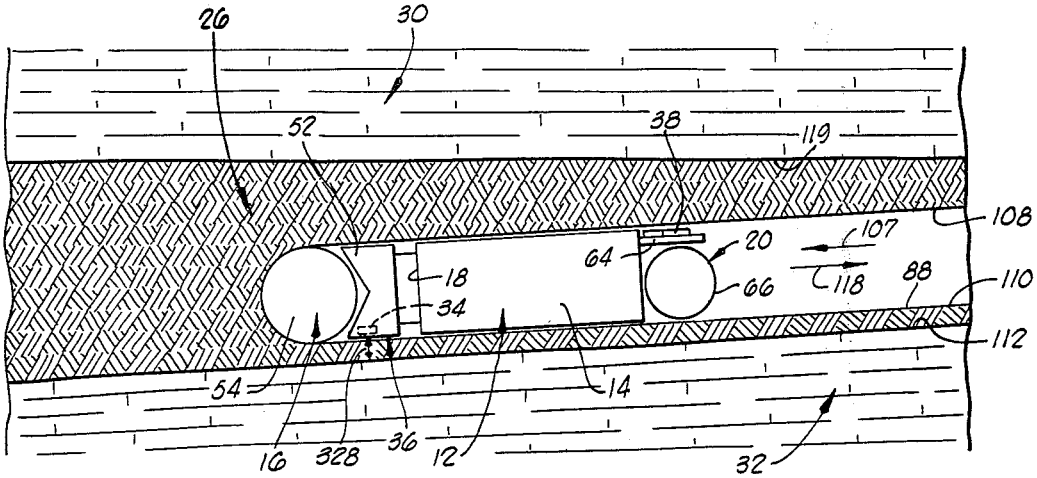
FIG. 5 is a diagrammatic, schematic view showing a portion of the coal seam and illustrating the operation of the miner and assembly sensor of the present invention while moving the miner into the coal seam.
Figure 6:
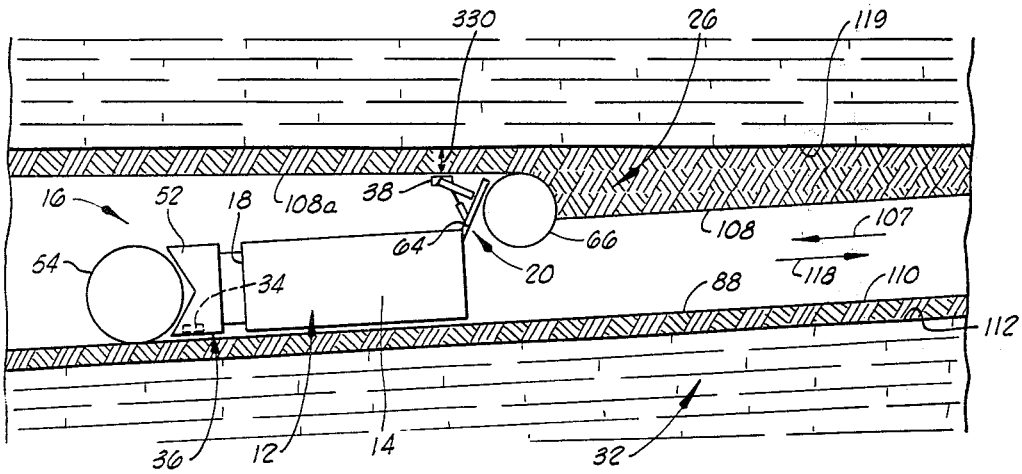
FIG. 6 is a view similar to FIG. 5, but illustrating the operation of the miner and the sensor assembly of the present invention while the miner is being withdrawn from the coal seam.

Since the distance 327 between the source 320 and the receiver 322 is known, the first or second distances (the thickness) can be determined from the response of the receiver 322, the first or second distances being shown in FIGS. 4, 5 and 6 and designated therein via the reference numerals 328 and 330, respectively. As indicated in FIG. 4 by the dashed-line 324, all of the radiation emitted from the source 320 is not received by the receiver 322 and it is the amount of radiation received by the receiver 322 which indicates the first and second distances 328 and 330. As diagrammatically shown in FIG. 7, the amount of radiation received or detected by the receiver 322 can be plotted as a function of the first and second distances 328 and 330 (thickness). As shown in FIG. 7, if the amount of radiation received by the receiver 322 is determined to be at the level designated via the reference numeral 334, then the thickness or, more particularly, the first or second distance 328 or 330 is determined to the thickness indicated by the reference numeral 336.

The receiver 322 is constructed to generate and produce a voltage output signal which is proportional to the radiation detected or received by the receiver 322. This voltage output signal is the output signal of the first and second sensor assemblies 34 and 38 which is applied to the control lines 100 and 102, respectively. As mentioned before, the first sensor assembly 100 includes a first and a second sensor 300 and 302 and each of these sensors 300 and 302 produces a voltage output signal which is indicative of the amount of radiation detected or received by the receivers in each of the sensors 300 and 302. Thus, in this particular embodiment, the control line 100 actually represents two separate signal paths, wherein the output signal of the sensor 300 is applied to one of the signal paths of the control line 100 and the output signal of the second sensor 302 is applied to the other signal path of the control line 100. By the same token, the output signal of the third sensor 304 or, in other words, the output signal of the second sensor assembly 38 is applied to control line 102. The output signals of the first and the second sensor assemblies 34 and 38 are each received by the control unit 98.

As shown in FIG. 7, the curve has a relatively steep slope between points "A" and "B". Thus, in this range, the thickness of the coal seam can be determined as a function of the detected or received radiation with a relatively high degree of accuracy. However, the slope of the curve between points "B" and "C" and between "C" and "D" is relatively small. Thus, it is extremely difficult to determine the thickness of the coal seam in the range of thickness between points "B" and "C" and between points "C" and "D". As indicated by the arrow in FIG. 7, the thickness of the coal seam increases to the right. Thus, it is more difficult to determine the thickness of the coal seam as a function of the received or detected radiation as the thickness to be determined increases. As a point of reference, the thickness of the coal seam midway between points "B" and "C" typically would be about sixteen inches, the thickness of the coal seam at 336 typically would be about ten inches, and the thickness of the coal seam midway between points "C" and "D" typically would be about three or four feet. By positioning the first and the second sensors 300 and 302 near and behind the forward cutter 54 and by positioning the third sensor 304 near and behind the rearward cutter 66, the sensors 300, 302 and 304 are each positioned to detect or sense the thickness of coal from a surface 108*a* and 110 which has been cut in the coal seam by the forward and the rearward cutters 54 and 66 to the interface 112 or 119, thereby minimizing the distance to be sensed or determined utilizing the sensors 300, 302 and 304 as compared to systems wherein a pilot hole is drilled in the coal seam and sensors are utilized to determine in advance of the cutter the thickness of the coal seam relative to the pilot hole. By positioning the sensors 300, 302 and 304 in the manner just described, the thickness to be sensed or detected by the sensors 300, 302 and 304 should be in the range represented by the curve in FIG. 7 between points "A" and "B", thereby providing a more accurate measurement utilizing the system of the present invention as compared to systems wherein the sensors are required to determine thickness in the range represented by the curve in FIG. 7 between points "B" and "D".

As indicated more clearly in FIGS. 5 and 6, the miner 14 is controlled to minimize the distances 328 and 330 and, more particularly, the miner 14 is controlled to maintain the distances 328 substantially constant or the same throughout the length of the borehole 88 and to maintain the distances 330 substantially the same or constant throughout the length of the borehole 88. In any event, operating according to the system of the present invention, there will only be slight variations in the distances 328 throughout the length of the borehole 88 and there will be only slight variations in the distances 330 throughout the length of the borehole 88. Thus, the sensors 300, 302 and 304 and the control unit 98 can be designed and constructed to measure thicknesses over a relatively small range, thereby increasing the accuracy of such measurements.

As mentioned before, the sensors 300, 302 and 304 produce a signal proportional to the sensed or detected radiation and the amount of radiation detected or received by the receiver 322 is utilized to determine the thickness of the coal seam. Thus, it is important that substantially all of the radiation emitted from the source 320 pass through the coal seam before being received at the receiver 322. It has been found that some radiation emitted from source 320 will travel or pass directly to and be detected by the receiver 322 without first passing through the coal seam. Of course, this detected radiation will be present or indicated in the output signal produced by the sensors 300, 302 and 304 and the amount of radiation thus detected will include both radiation which has passed through the coal seam and radiation which has passed directly to the receiver 322 without first passing through the coal seam. Thus, the total amount of radiation detected by the receiver 322 will not accurately reflect the thickness of the coal seam because some of the detected radiation did not pass through the coal seam.

For the foregoing reasons, it is important to position and construct the sensors 300, 302 and 304 in such a manner as to assure that substantially all of the radiation emitted by the source 320 passes through the coal seam before being received by the receiver 322. One solution to this problem would be to place or position the source 320 and the receiver 322 flush or immediately adjacent the surface 108, 108*a* or 110 formed in the borehole 88. However, this solution is practical only if the surface 108, 108*a* or 110 is substantially flat and, even in this event, it is difficult to construct a sensor which can be placed flush against the borehole surface because the operating sensors 300, 302 and 304 will be rubbing against the borehole surface as the miner 14 is being moved into and withdrawn from the borehole 88. Further, the surfaces 108, 108*a* and 110 will not be flat, rather, these surfaces 108, and 108*a* and 110 will be rough since they were formed by the cutters 54 or 66.

As mentioned before, the borehole 88 is filled with working fluid at least to the extent that the miner 14 substantially submerged during the operations of the present system. Thus, the area or space between the sensors 300, 302 and 304 and the borehole walls 108*a* and 110 substantially is filled with working fluid, as shown in FIG. 4. It has been found that the working fluid in the space between the sensors 300, 302 and 304 and the borehole wall 108*a* or 110 functions to direct substantially all of the radiation emitted by the source 320 into and through the coal seam 26 or, in other words, the working fluid substantially prevents radiation emitted from the source 320 from passing directly to the receiver 322 without first passing through the coal seam 26. Thus, following the system of the present invention, the amount of radiation received or detected by the receiver 322 will indicate more accurately the thickness of the coal seam 26 or, in other words, the distances 328 and 330.

It should be noted other materials or fluids could be used in lieu of the working fluid substantially to prevent radiation emitted from the source 320 from passing directly to the receiver 322 without first passing through the coal seam 26. The material or fluid so used must have a density greater than the density of air and should be at least as dense as water. The material or fluid so used could have a density near that of coal; however, the density could be greater than the density of coal and still function to direct the radiation emitted from the source 320 through the coal seam 26.

As shown in FIG. 5, the miner 14 is being moved into the coal seam 26 in the direction 107 and the forward cutter 54 is excavatingly engaging the coal seam 26 to form the borehole 88. The first sensor assembly 34 or, more particularly, the first and the second sensors 300 and 302 each function to continuously sense the first distance 328 between one side (the floor 110) of the borehole 88 and the underburden 32. The first and the second sensors 300 and 302 are located on opposite sides of the forward cutter frame 52 and thus the first distance 328 is sensed or determined in response to the output signals received from the first and the second sensors 300 and 302 at two different positions at opposite sides of the forward cutter frame 52.

The position of the forward cutter assembly 16 is continuously adjusted in response to the sensed or determined first distance 328 to substantially maintain the first distance 328 substantially constant as the miner 14 is being moved into and through the coal seam 26 in the direction 107.

As shown diagrammatically in FIG. 6, when the miner 14 is being withdrawn from the coal seam 26, the rearward cutter assembly 20 is positioned in the material engaging position wherein the rearward cutter 66 excavatingly engages the coal seam 26 generally adjacent the roof 108 of the borehole previously formed by the forward cutter 54. In the material engaging position of the rearward cutter assembly 20, the second sensor assembly 38 or, more particularly, the third sensor 304, is positioned generally adjacent the roof 108*a* formed by the rearward cutter 66. As the miner 14 is being moved in the withdrawal direction 118, the rearward cutter 66 excavatingly engages the coal seam 26 and the second sensor assembly 38 continuously senses the second distance 330 between the roof 108*a* and the interface 119, the second sensor assembly 38 providing an output signal indicative of the sensed distance 330. The position of the rearward cutter assembly 20 is continuously adjusted in response to the signal received from the second sensor assembly 38 indicating the sensed second distance 330, the rearward cutter assembly 20 being adjusted to maintain the second distance 330 substantially constant as the miner 14 is being withdrawn from the coal seam 26 in the withdrawal direction 118.

As the miner 14 is being withdrawn from the coal seam, the forward cutter 54 remains positioned in the borehole 88 formed by the forward cutter 54 when the miner 14 was being moved into the coal seam 26. The maintaining of the forward cutter 54 in the borehole 88 previously formed by the forward cutter 54 as the miner 14 is being moved in the withdrawal direction 118 effectively operates to guide the miner 14 as the miner 14 is being moved in the withdrawal direction 118 in a manner described in the co-pending application referred to before. Since the forward cutter 54 effectively operates to guide the miner 14 as the miner 14 is being moved in the withdrawal direction 118, it only is necessary to have one sensor in the second sensor assembly 38 since the rearward cutter positioning assembly 72 will function only to move the rearward cutter 66 in the direction 120 or the direction 122.

It should be noted that the sensors 300, 302 and 304 each provide an output signal indicative of the amount of radiation received by one of the receivers 322 and this output signal is indicative of the distances as illustrated in FIG. 7. The output signals from the sensors 300, 302 and 304 are each received by the control unit 98 and the control unit 98 provides output signals on the control lines 62 and 74 which are received by the forward and the rearward cutter positioning assemblies 60 and 72, respectively, the forward and the rearward cutters 54 and 66 being positioned by the forward and the rearward cutter positioning assemblies 60 and 72, respectively, in response to the signals provided by the control unit 98.

Figure 8:
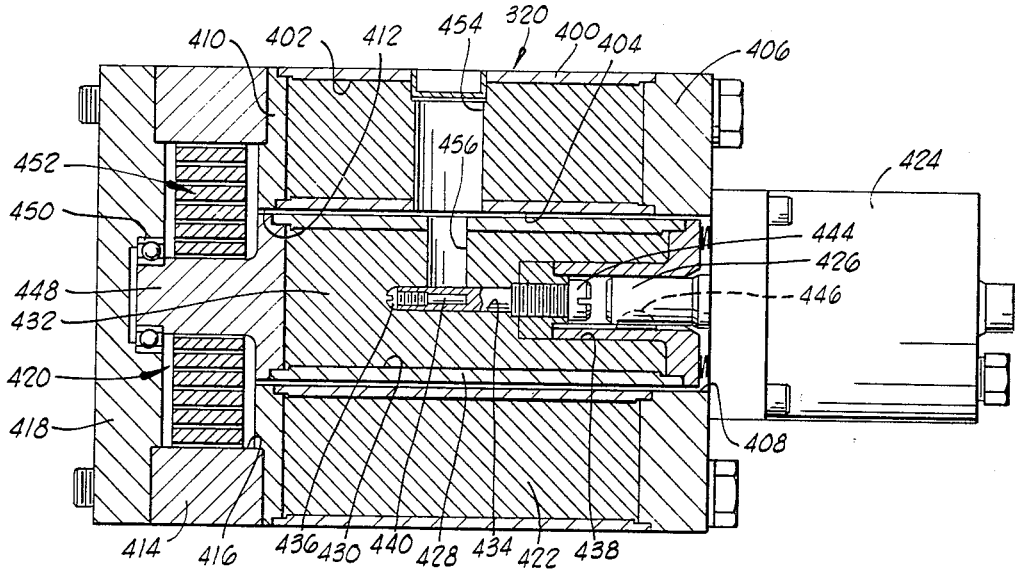
FIG. 8 is a cross-sectional view of the radiation source of the present invention.
Figure 9:
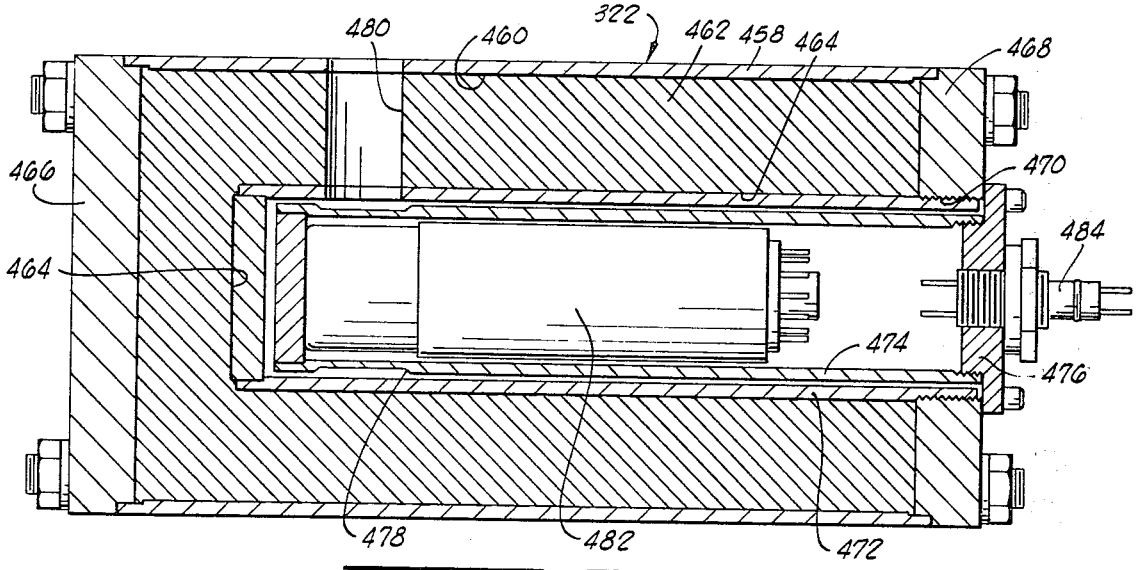
FIG. 9 is a cross-sectional view of the radiation receiver of the present invention.

Embodiments of FIGS. 8 and 9

Shown in FIG. 8 is one embodiment of the radiation source 320 and shown in FIG. 9 is one embodiment of the radiation receiver 322.

The radiation source 320 includes a tubular housing 400 having an opening 402 extending therethrough and intersecting the opposite ends thereof and an opening 404 extending through a central portion of the housing 400 and intersecting the opposite ends thereof.

An end plate 406 is secured to one end of the housing 400. The end plate 406 has an opening 408 formed through a central portion thereof and, in an assembled position, the opening 408 is aligned with the opening 404 in the housing 400.

A plate 410 is secured to one end of the housing 400, opposite the end of the housing 400 having the end plate 406 secured thereto. An opening 412 is formed through a central portion of the plate 410 and in an assembled position, the opening 412 is aligned with the opening 404 through the housing 400. A cylindrically shaped spring retainer 414 is connected to the plate 410. The retainer 414 has an opening 416 extending through a central portion thereof and intersecting the opposite ends thereof. An end plate 418 is secured to the retainer 414. The end plate 418, the opening 416 through the retainer 414 and the plate 410 cooperate to encompass a space 420.

The opening 404 through the housing 400 is filled with a lead shield 422. The lead shield 422 extends around and encompasses the opening 404.

A rotary actuater 424, having an output shaft 426, is connected to the end plate 406. The shaft 426 extends a distance into the opening 404 in an assembled position with the rotary actuator 424 connected to the end plate 406.

A tubular shaped member 428, having an opening 430 formed through a central portion thereof and intersecting the opposite ends thereof, is disposed within the opening 404 of the housing 400. The member 428 is shaped and positioned within the opening 404 so that the member 428 can be rotated within the opening 404 during the operation of the radiation source 320. The opening 430 is filled with a lead shield 432. An opening 434 is formed through one end of the shield 432 and the opening 434 extends a distance through the shield 432 terminating with an end 436. A portion 438 of the opening 434 is enlarged, the enlarged portion 438 extending through an intersecting one end of the shield 432.

A radiation emitting material 440 is secured within the opening 434 by a screw 444. In a preferred embodiment, the radiation emitting material 440 emits gamma ray type radiation. Radiation emitting materials capable of emitting gamma ray type radiation are well known in the art and a detailed description of such materials is not required herein.

The shaft 426 of the rotary actuator 424 extends through the enlarged portion 438 of the opening 434. The shaft 426 is connected to a key number 446. The key member 446 is connected to the lead shield 432 which is secured within the member 428, thereby connecting the member 428 to the shaft 426.

A stub shaft 448 is connected to the end of the member 428, generally opposite the end of the member 428 which is connected to the shaft 426 of the rotary actuator 424. The stub shaft 448 extends through the opening 420 and one end of the stub shaft 448 is bearingly supported in the end plate 418 by a bearing member 450. Thus, the member 428 containing the radiation emitting material 440 is supported within the opening 404 such that the member 428 can be rotated within the opening 404 by the rotary actuator 424 during the operation of the radiation source 320.

A torsion spring 452 is disposed within the opening 420. One end of the torsion spring 452 is secured to the stub shaft 448 and the opposite end of the torsion spring 452 is secured to the retainer 414.

An opening 454 is formed through the housing 400 and the opening 454 extends transversely through the housing 400 and transversely through the shield 422. The opening 454 intersects and communicates with the opening 404 through the housing 400. An opening 456 is formed through the member 428, the opening 456 extending transversely through the member 428 and the opening 456 extending a distance transversely through the shield 432. One end of the opening 456 intersects the opening 434. The opening 456 is positioned such that the opening 456 communicates with the radiation emitting material 440. In a storage position of the radiation source 320, the member 428 is rotated within the opening 404 to a position wherein the opening 406 is disposed about ninety degrees (90°) from the position of the opening 456 shown in FIG. 8. In other words, in the storage position of the radiation source 320, the member 428 is rotated in the housing 400 to a position wherein the opening 456 is not aligned or in communication with the opening 454. In the storage position, the radiation source 320 does not emit gamma ray radiation since the openings 454 and 456 are not aligned.

To position the radiation source 320 in an emitting position wherein the radiation source 320 emits gamma ray radiation, the rotary actuator 424 is actuated to drivingly rotate the member 428 within the opening 404. The rotary actuator 424 rotatingly drives the member 428 to a position wherein the opening 456 is aligned with the opening 454, thereby providing communication between the radiation emitting material 440 and the environment outside the radiation source 320 via the aligned openings 454 and 456.

The torsion spring 452 is oriented and connected to the stub shaft 448 and the retainer 414 such that the torsion spring 452 tends to rotate the member 428 in a direction generally opposite the direction the member 428 is rotated by the rotary actuator 424. Thus, when the rotary actuator 424 is conditioned in the "off" condition, the torsion spring 452 rotates the member 428 to the storage position wherein the openings 454 and 456 are not aligned. Also, the torsion spring 452 provides a safety function in that the torsion spring 452 operates to continually bias the member 428 to the storage position wherein the radiation source 320 is not emitting gamma ray radiation.

One embodiment of the radiation receiver 322 is shown in FIG. 9 and, as shown therein, the radiation receiver 322 includes a tubular housing 458, having opposite ends and an opening 460 extending through a central portion and intersecting the opposite ends thereof. The opening 460 is filled with a lead shield 462 and an opening 464 is formed through a central portion of the lead shield 462, the opening 464 extending through one end of the lead shield 462 through the lead shield 462 and terminating with an end 464.

An end plate 466 is secured to one end of the housing 458 and an end plate 468 is secured to the opposite end of the housing 458. An opening 470 is formed through a central portion of the end plate 466.

A tubular shaped member 472 is secured within the opening 464, the tubular shaped member 472 being threadedly connected to the end plate 468, as shown in FIG. 9. A tubular shaped insert 474 is disposed within the opening 464 and, more particularly, disposed within the opening formed via the tubular shaped member 472, the tubular shaped insert 474 being threadedly connected to a plate 476. The plate 476 is secured to the end plate 468 for securedly supporting the insert 474 within the tubular shaped member 472.

An opening 478 is formed through the tubular shaped member 472. An opening 480 is formed through the tubular housing 458 and through the shield 462, the opening 480 extending transversely through the housing 458, through the shield 462 and through the member 472. The opening 480 is aligned with the opening 478.

A scintillator 482 is disposed and supported within the opening through the insert 474. The scintillator 482 is designed and constructed to receive gamma ray radiation and to provide an output signal indicative of the amount of radiation received. The scintillator 482 is connected to a connector 484 via a cable (not shown in FIG. 9) and the output signal provided via the scintillator 482 is connected to a control line (not shown in FIG. 9) via the connector 484. Scintillators which are constructed to receive gamma ray radiation and to provide an output signal indicative of the amount of radiation received are well known in the art and the detailed description of the construction and operation of such scintillators is not deemed necessary.

The output signal provided by the radiation source 322 constitutes the signal connected to the control line (not shown in FIG. 9) at the connector 484, the connector 484 being connected to the scintillator 482 via a control line (not shown in FIG. 9).

Figure 10:
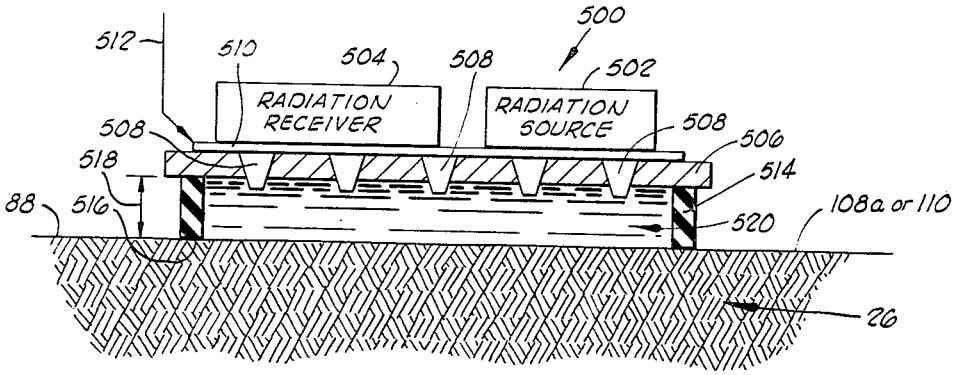
FIG. 10 is a view similar to FIG. 4, but showing a modified sensor assembly.

Embodiment of FIG. 10

Shown in FIG. 10 and designated therein via the reference numeral 500 is a modified sensor which is constructed and operated exactly like the sensors 300, 302 and 304 which have been described in detail above, except as specifically noted below. It may not always be possible to submerge the miner 14 in working fluid; however, it is important to fill substantially the space between the sensor 500 and the borehole wall 108*a* or 110 with a fluid or material of the type described before. The sensor 500 has been constructed to maintain the space between the sensor 500 and the borehole wall 108*a* or 110 substantially filled with such fluid or material.

The sensor 500 includes a source 502 and a receiver 504 which are constructed and operated exactly like the source 320 and the receiver 322 which has been described in detail above. The source 502 and the receiver 504 are each mounted on a plate 506 which could be a portion of the structure supporting either of the sensors 300, 302 or 304.

A plurality of openings are formed through the plate 506 and a nozzle 508 is positioned and secured within each of the openings formed in the plate 506. One end portion of a pipe 510 is connected to each of the nozzles 508 (only some of the nozzles 508 are designated by a reference numeral in FIG. 10) and the opposite end of the pipe 510 is connected to a fluid source (not shown in the drawings) via a conduit 512. The fluid source can be positioned on the surface as a part of the surface assembly 24 so fluid from the fluid source can be supplied to nozzles 508 from a remote position at the surface.

One end of a resilient member 514 is sealingly connected to the surface of the plate 506, opposite the surface of the plate 506 on which the sensor 500 is supported. The resilient member 514 extends a distance from the plate 506 terminating with an end 516. The resilient member 514 completely surrounds the nozzles 508.

During the operation of the sensors 500, the plate 506 is positioned near and spaced a distance 518 from the wall 108*a* or 110 to a position wherein the end 516 of the resilient member 514 sealingly engages the wall 108*a* or 110. In this position, the resilient member 514 cooperates with the plate 506 to enclose a space 520 extending between the sensor 502 and the receiver 504 and the wall 108*a* or 110, a portion of the nozzles 508 being in communication with the space 520. Fluid from the fluid source then is passed through the conduit 512, through the pipe 510 and through the nozzles 508, the fluid being passed from the nozzles 508 into the space 520. The fluid is passed into the space 520 until the space 520 substantially is filled with the fluid, as shown in FIG. 10. The fluid substantially is retained within the space 520 by the resilient member 514.

An amount of fluid may leak between the end 516 of the resilient member 514 and the wall 108*a* or 110. In this event, the fluid source (not shown) functions to pass additional fluid into the space 520. In some instance, it may be desirable to continually pass an amount of fluid into the space 520 in anticipation of some leakage to maintain the space 520 substantially filled with fluid.

Changes may be made in the construction and the operation of the various components and assemblies described herein and in the various steps and in the sequence of steps of the methods described herein without departing from the spirit and the scope of the invention as defined in the following claims.

What is claimed is:

1. A method for mining a mineral from a mineral seam in an earth formation with a miner having a positionable cutter assembly, comprising:

moving the miner into the mineral seam;

removing mineral from the mineral seam with the miner cutter assembly while moving the miner into the mineral seam, thereby forming a borehole in the mineral seam;

sensing continuously a first distance between one side of the borehole and one of the overburden and the underburden while moving the miner into the mineral seam, comprising the steps of:

providing a radiation source and a radiation receiver;

positioning the radiation source and the radiation receiver near one side of the borehole formed by the miner cutter assembly while moving the miner into the mineral seam;

emitting radiation from the radiation source while moving the miner into the mineral seam;

detecting with the radiation receiver some of the radiation emitted from the radiation source and reflected from the interface between the mineral seam and one of the overburden and the underburden while moving the miner into the mineral seam;

determining the first distance in response to the detected radiation; and filling a substantial portion of the space between the wall and the radiation source with a material having a density greater than the density of air prior to the steps of emitting and detecting radiation while moving the miner into the mineral seam;

adjusting the position of the miner cutter assembly in response to the sensed first distance while moving the miner into the mineral seam;

withdrawing the miner from the mineral seam;

removing mineral from the mineral seam with the miner cutter assembly while withdrawing the miner from the mineral seam thereby enlarging the borehole formed while moving the miner into the mineral seam;

sensing continuously a second distance between one side of the borehole formed by the removal of mineral during the withdrawal of the miner and one of the overburden and the underburden while withdrawing the miner from the mineral seam, comprising the steps of:

positioning the radiation source and the radiation receiver near one side of the borehole formed by the miner cutter assembly while withdrawing the miner from the mineral seam;

emitting radiation from the radiation source while withdrawing the miner from the mineral seam;

detecting with the radiation receiver some of the radiation source and reflected from the interface between the mineral seam and one of the overburden and the underburden while withdrawing the miner from the mineral seam;

determining the second distance in response to the detected radiation; and filling a substantial portion of the space between the wall and the radiation source with a material having a density greater than the density of air prior to the steps of emitting and detecting radiation while withdrawing the miner from the mineral seam; and adjusting the position of the miner cutter assembly in response to the second distance while withdrawing the miner from the mineral seam.

2. The method of claim 1 wherein the step of positioning the radiation source and the radiation receiver while moving the miner into the mineral seam is defined further as positioning the radiation source and the radiation receiver near the floor of the borehole formed by the miner cutter assembly while moving the miner into the mineral seam; and wherein the step of detecting the radiation is defined further as detecting with the radiation receiver radiation emitted from the radiation source and reflected from the interface between the mineral seam and the underburden while moving the miner into the mineral seam; and wherein the step of positioning the radiation source and the radiation receiver while withdrawing the miner from the mineral seam is defined further as positioning the radiation source and the radiation receiver near the roof of the borehole formed by the cutter assembly while withdrawing the miner from the mineral seam; and wherein the step of detecting the radiation is defined further as detecting with the radiation receiver radiation emitted from the radiation source and reflected from the interface between the mineral seam and the overburden while withdrawing the miner from the mineral seam.

3. The method of claim 1 wherein the miner cutter assembly includes a forward cutter assembly and a rearward cutter assembly, and wherein the step of removing coal from the mineral seam while moving the miner into the mineral seam is defined further to include the steps of:

positioning the forward cutter assembly to excavating engage the mineral seam; and excavating mineral from the mineral seam via the forward cutter assembly while moving the miner into the mineral seam; and wherein the step of positioning the radiation source and the radiation receiver is defined further as positioning the radiation source and the radiation receiver near the forward cutter assembly and near one side of the borehole formed by the forward cutter assembly; and wherein the step of adjusting the position of the cutter assembly is defined further as adjusting the position of the forward cutter assembly in response to the sensed first distance; and wherein the step of removing mineral from the mineral seam while withdrawing the miner from the mineral seam is defined further to include the steps of:

positioning the rearward cutter assembly to excavatingly engage a portion of the mineral seam adjacent the borehole formed by the forward cutter assembly; and excavating mineral from the mineral seam via the rearward cutter assembly while withdrawing the miner from the mineral seam; and wherein the step of positioning the radiation source and the radiation receiver is defined further as positioning the radiation source and the radiation receiver near the rearward cutter assembly and near one side of the borehole formed by the rearward cutter assembly; and wherein the step of adjusting the position of the rearward cutter assembly in response to the sensed second distance.

4. The method of claim 1 wherein the step of adjusting the position of the cutter assembly is defined further as adjusting the position of the miner cutter assembly to minimize the first distance while moving the miner into the mineral seam; and wherein the step of adjusting the position of the miner cutter assembly is defined further as adjusting the position of the miner cutter assembly to minimize the second distance while withdrawing the miner from the mineral seam.

5. The method of claim 1 wherein the step of adjusting the position of the cutter assembly is defined further as adjusting the position of the miner cutter assembly to maintain the first distance substantially constant while moving the miner into the mineral seam; and wherein the step of adjusting the position of the miner cutter assembly is defined further as adjusting the position of the miner cutter assembly to maintain the second distance substantially constant while withdrawing the miner from the mineral seam.

6. The method of claim 1 defined further to include the steps of:

maintaining a substantial portion of the space between the wall and the radiation source filled with the material while detecting the first distance during the movement of the miner into the mineral seam; and maintaining a substantial portion of the space between the wall and the radiation source filled with the material while detecting the second distance during the withdrawal of the miner from the mineral seam.

7. A method for mining a mineral from a mineral seam in an earth formation with a miner having a positionable cutter assembly, comprising:

moving the miner into the mineral seam;

removing mineral from the mineral seam with the miner cutter assembly while moving the miner into the mineral seam, thereby forming a borehole in the mineral seam;

sensing continuously a first distance between one side of the borehole and one of the overburden and the underburden while moving the miner into the mineral seam, comprising the steps of:

providing a radiation source and a radiation receiver;

positioning the radiation source and the radiation receiver near one side of the borehole formed by the miner cutter assembly while moving the miner into the mineral seam;

emitting radiation from the radiation source while moving the miner into the mineral seam;

detecting with the radiation receiver some of the radiation emitted from the radiation source and reflected from the interface between the mineral seam and one of the overburden and the underburden while moving the miner into the mineral seam;

determining the first distance in response to the detected radiation; and filling a substantial portion of the space between the wall and the radiation source and the radiation receiver with a material having a density greater than the density of air prior to the steps of emitting and detecting radiation while moving the miner into the mineral seam;

adjusting the position of the miner cutter assembly in response to the sensed first distance while moving the miner into the mineral seam;

withdrawing the miner from the mineral seam;

removing mineral from the mineral seam with the miner cutter assembly while withdrawing the miner from the mineral seam thereby enlarging the borehole formed while moving the miner into the mineral seam; and sensing continuously a second distance between one side of the borehole formed by the removal of mineral during the withdrawal of the miner and one of the overburden and the underburden while withdrawing the miner from the mineral seam, comprising the steps of:

positioning the radiation source and the radiation receiver near one side of the borehole formed by the miner cutter assembly while withdrawing the miner from the mineral seam;

emitting radiation from the radiation source while withdrawing the miner from the mineral seam;

detecting with the radiation receiver some of the radiation source and reflected from the interface between the mineral seam and one of the overburden and the underburden while withdrawing the miner from the mineral seam;

determining the second distance in response to the detected radiation; and filling a substantial portion of the space between the wall and the radiation source and the radiation receiver with a material having a density greater than the density of air prior to the steps of emitting and detecting radiation while withdrawing the miner from the mineral seam; and adjusting the position of the miner cutter assembly in response to the second distance while withdrawing the miner from the mineral seam.

8. The method of claim 7 defined further to include the steps of:

maintaining a substantial portion of the space between the wall and the radiation source and the radiation receiver filled with the material while detecting the first distance during the movement of the miner into the mineral seam; and maintaining a substantial portion of the space between the wall and the radiation source and the radiation receiver filled with the material while detecting the second distance during the withdrawal of the miner from the mineral seam.

9. A method for mining a mineral from a mineral seam with a miner having a positionable cutter assembly, comprising:

moving the miner into the mineral seam;

removing mineral from the mineral seam with the miner cutter assembly while moving the miner into the mineral seam, thereby forming a borehole in the mineral seam;

sensing continuously a first distance between one side of the borehole and one of the overburden and the underburden while moving the miner into the mineral seam, comprising the steps of:

providing a radiation source and a radiation receiver;

positioning the radiation source and the radiation receiver near one side of the borehole formed by the miner cutter assembly while moving the miner into the mineral seam;

emitting radiation from the radiation source while moving the miner into the mineral seam;

detecting with the radiation receiver some of the radiation emitted from the radiation source and reflected from the interface between the mineral seam and one of the overburden and the underburden while moving the miner into the mineral seam; and determining the first distance in response to the detected radiation; and filling a substantial portion of the space between the wall and the radiation source with a material having a density greater than the density of air prior to the steps of emitting and detecting radiation while moving the miner into the mineral seam.

10. The method of claim 9 defined further to include the step of:

maintaining a substantial portion of the space between the wall and the radiation source filled with the material while detecting the first distance during the movement of the miner into the mineral seam.

11. The method of claim 9 wherein the step of positioning the radiation source and the radiation receiver while moving the miner into the mineral seam is defined further as positioning the radiation source and the radiation receiver near the floor of the borehole formed by the miner cutter assembly while moving the miner into the mineral seam; and wherein the step of detecting the radiation is defined further as detecting with the radiation receiver radiation emitted from the radiation source and reflected from the interface between the mineral seam and the underburden while moving the miner into the mineral seam.

12. The method of claim 9 defined further to include the step of:

adjusting the position of the miner cutter assembly in response to the sensed first distance while moving the miner into the mineral seam.

13. The method of claim 12 wherein the step of adjusting the position of the cutter assembly is defined further as adjusting the position of the miner cutter assembly to minimize the first distance while moving the miner into the mineral seam.

14. The method of claim 12 wherein the step of adjusting the position of the cutter assembly is defined further as adjusting the position of the miner cutter assembly to maintain the first distance substantially constant while moving the miner into the mineral seam.

15. The method of claim 9 defined further to include the step of:

filling a substantial portion of the space between the wall and the radiation receiver with a material having a density greater than the density of air prior to the steps of emitting and detecting radiation while moving the miner into the mineral seam.

16. The method of claim 15 defined further to include the step of:

maintaining a substantial portion of the space between the wall and the radiation receiver filled with the material while detecting the first distance during the movement of the miner into the mineral seam.

17. An apparatus adapted for use in sensing the distance between a wall formed in a mineral seam and an interface between the mineral seam and the surrounding earth formation, comprising:

a radiation source for emitting radiation positionable near and spaced a distance from the wall in the mineral seam;

a radiation receiver for receiving radiation emitted from the radiation source positionable near and spaced a distance from the wall in the mineral seam;

means for maintaining the space between the radiation source, the radiation receiver and the wall in the mineral seam substantially filled with a material having a density greater than the density of air, comprising:

a member, having one end connected to the plate, the member extending a distance from the plate terminating with an opposite end engagable with the wall in the mineral seam and the member surrounding the space between the radiation source and the radiation receiver and the wall in the mineral seam; and means for substantially filling the space surrounded by the member with a material having a density greater than the density of air.

18. An apparatus adapted for use in sensing the distance between a wall formed in a mineral seam and an interface between the mineral seam and the surrounding earth formation, comprising:

a radiation source for emitting radiation positionable near and spaced a distance from the wall in the mineral seam;

a radiation receiver for receiving radiation emitted from the radiation source positionable near and spaced a distance from the wall in the mineral seam;

a plate, the radiation source and the radiation receiver being supported on the plate, the plate being positionable near and spaced a distance from the wall in the mineral seam; and means for maintaining the space between the radiation source and the radiation receiver and the wall in the mineral seam substantially filled with a material having a density greater than the density of air, comprising:

an elastomeric member, having one end connected to the plate, the elastomeric member extending a distance from the plate terminating with an opposite end engagable with the wall in the mineral seam and the elastomeric member surrounding the space between the radiation source and the radiation receiver and the wall in the mineral seam;

at least one nozzle extending through the plate in communication with the space surrounded by the elastomeric member; and means for passing fluid through the nozzle and into the space surrounded by the elastomeric member.

19. A miner for forming a borehole in a mineral seam in an earth formation, comprising:

a frame having a forward end and a rearward end;

a forward cutter frame spaced a distance from the forward end of the frame;

a forward cutter rotatably connected to the forward cutter frame;

a forward cutter positioning assembly connected to the frame and to the forward cutter frame for movably positioning the forward cutter frame and the forward cutter connected thereto;

a first sensor assembly connected to the forward cutter frame and positioned near the forward cutter, the first sensor assembly being positionable near the wall formed in the mineral seam by the forward cutter, the first sensor assembly sensing a first distance between the wall formed by the forward cutter and an interface between the mineral seam and the surrounding earth formation and providing an output signal indicative of the sensed first distance, the first sensor assembly being positionable near and spaced a distance from the wall in the mineral seam during the operation of the miner;

a rearward cutter;

a rearward cutter frame movably connected to the rearward end of the frame, the rearward cutter being rotatably connected to the rearward cutter frame and the rearward cutter being movable from a storage position to a material engaging position wherein the rearward cutter excavatingly engages the mineral seam;

a rearward cutter positioning assembly connected to the rearward cutter frame for positioning the rearward cutter frame and the rearward cutter connected thereto in the material engaging position and the storage position;

a second sensor assembly connected to the rearward cutter frame and positioned near the rearward cutter, the second sensor assembly being positionable near the wall formed in the mineral seam by the rearward cutter in the material engaging position of the rearward cutter, the second sensor assembly sensing a second distance between the wall formed by the rearward cutter and an interface between the mineral seam and the surrounding earth formation and providing an output signal indicative of the sensed second distance, the second sensor being positionable near and spaced a distance from the wall in the mineral seam during the operation of the miner;

means for maintaining the space between the first sensor assembly and the wall in the mineral seam substantially filled with a material having a density greater than the density of air; and means for maintaining the space between the second sensor assembly and the wall in the mineral seam substantially filled with a material having a density greater than the density of air.

20. The miner of claim 19 defined further to include:

means for receiving the output signal from the first sensor assembly and for providing an output signal to the forward cutter positioning assembly for positioning the forward cutter to maintain the first distance substantially constant as the forward cutter excavatingly removes mineral from the mineral seam; and means for receiving the output signal from the second sensor assembly and for providing an output signal to the rearward cutter positioning assembly for positioning the rearward cutter to maintain the second distance substantially constant as the rearward cutter excavatingly removes mineral from the mineral seam.

21. The miner of claim 19 wherein the first sensor assembly is defined further to include:

a first sensor connected to the forward cutter frame and positioned near one side of the forward cutter frame comprising:

a radiation source for emitting radiation; and a radiation receiver for receiving some of the radiation emitted from the radiation source and reflected from an interface between the mineral seam and the surrounding earth formation, the radiation receiver providing an output signal indicative of the first distance measured relative to one side of the miner; and a second sensor connected to the forward cutter frame and positioned near one side of the forward cutter frame generally opposite the first sensor, comprising:

a radiation source for emitting radiation; and a radiation receiver for receiving some of the radiation emitted from the radiation source and reflected from an interface between the mineral seam and the surrounding earth formation, the radiation receiver providing an output signal indicative of the first distance measured relative to one side of the miner; and wherein the second sensor assembly is defined further to include:

a third sensor connected to the rearward cutter frame and positioned near the rearward cutter comprising:

a radiation source for emitting radiation; and a radiation receiver for receiving some of the radiation emitted from the radiation source and reflected from an interface between the mineral seam and the surrounding earth formation, the third sensor providing an output signal indicative of the second distance.

* * * * *